US005231365A

United States Patent [19]

Kato

[11] Patent Number: 5,231,365

[45] Date of Patent: Jul. 27, 1993

[54] CIRCUIT BREAKER

[75] Inventor: Kazuhiko Kato, Shibata, Japan

[73] Assignee: Hitachi, Ltd., Tokyo, Japan

[21] Appl. No.: 802,731

[22] Filed: Dec. 5, 1991

[30] Foreign Application Priority Data

Dec. 11, 1990 [JP] Japan ..... 2-401422

[51] Int. Cl.[5] ..... H01H 67/02

[52] U.S. Cl. ..... 335/132; 335/202

[58] Field of Search ..... 335/147, 14, 16, 20, 335/195, 132, 202; 200/147 R, 144 R

[56] References Cited

U.S. PATENT DOCUMENTS

| | | | |
|---|---|---|---|
| 3,343,108 | 9/1967 | Murai | 335/147 |
| 3,614,687 | 10/1971 | Iida | 335/195 |
| 3,815,059 | 6/1974 | Spoelman | 335/195 |
| 4,408,173 | 10/1983 | Adlertag et al. | 335/16 |
| 4,417,223 | 11/1983 | Bancalari | 335/195 |
| 4,644,308 | 2/1987 | Guery et al. | 335/128 |

FOREIGN PATENT DOCUMENTS 53-57473 5/1978 Japan .

*Primary Examiner*—Lincoln Donovan

*Attorney, Agent, or Firm*—Fay, Sharpe, Beall, Fagan, Minnich & McKee

[57] ABSTRACT

The present invention aims to provide a current-limiting circuit breaker which is improved in assembling efficiency and which can readily cope with diversification of specifications. The circuit breaker of the invention comprises power source side contact unit including a group of component parts containing a power source side contact and movable contact unit including a group of component parts containing a load side contact. The units are detachably connected to each other. The movable unit is selectively connected to the various power source side contact units. Therefore, according to the invention, circuit breakers of various kinds of types can be obtained which are more useful, and manufactured by a small number of component parts some of which are commonly used in products. The circuit breakers can readily cope with the diversification of the specifications, and are improved in assembling efficiency.

8 Claims, 12 Drawing Sheets

CIRCUIT BREAKER

BACKGROUND OF THE INVENTION

1. Field of the Invention

The present invention relates to a switchgear of an electric circuit and, more particularly, to a circuit breaker which is preferably applicable for various specifications and which is improved in assembling efficiency.

2. Description of the Prior Art

As disclosed in Japanese Patent Unexamined Publication No. 53-57473, a conventional circuit breaker generally includes a power source side terminal and a power source side contact electrically connected to the power source side terminal. They are arranged in a base at the lower portion thereof. The conventional circuit breaker also includes a movable contact, a switching mechanism for the movable contact, an electromagnetic tripping device which operates in response to an overcurrent flowing through the movable contact so as to trip the switching mechanism, and a load side terminal electrically connected to the movable contact via a coil of the electromagnetic tripping device. They are disposed above the power source side terminal and the power source side contact. The upper portions of the switching mechanism and the electromagnetic tripping device project from the upper edge of the base. A cover for protecting those projecting upper portions and the portions of the movable contact and the power source side contact is disposed in such manner.

The above-described prior art adopts such arrangement that the respective component parts are incorporated in the base, which causes a difficulty in assembling because some of the component parts are vertically overlaid. Further, the prior art circuit breakers whose specifications such as rated currents, breaking current capacities or contact structures are different from one another cannot be assembled unless the specifications of the circuit breakers are established and the component parts used in the circuit breakers are determined. The prior art involves a problem in that it is hard to cope with the diversification of the specifications of the circuit breakers.

The present invention aims to solve the abovementioned problems. It is an object of the present invention to provide a circuit breaker which can readily cope with diversification of the specification and which is excellent in assembling efficiency.

SUMMARY OF THE INVENTION

To this end, according to the present invention, a circuit breaker is constructed in a manner as follows.

A circuit breaker comprises power source side contact unit including a power source side terminal, a power source side contact connected to the power source side terminal, a power source side contact carrier to which the power source side contact is secured, and a mount on which the power source side contact carrier is mounted, and movable contact unit including a movable contact, a movable contact arm to which the movable contact is secured, a load side terminal connected to the movable contact arm, a mechanism for switching the movable contact arm, means for detecting an overcurrent flowing through the movable contact, means for tripping the switching mechanism in response to a movement of the overcurrent detecting means, and a casing for accommodating therein the movable contact, the load side terminal, the switching mechanism, the overcurrent detecting means and the tripping means, the power source side contact unit and the movable contact unit being integrated with each other by attaching the mount of the power source side contact units to the casing of the movable contact units.

According to another aspect of the invention, the circuit breaker comprises a power source side contact unit and a movable contact unit which are integrally connected to each other, the power source side contact unit selected from a plurality of power source side contact units having different contact structures and the movable contact unit selected from a plurality of movable contact units having different rated currents, respectively.

With the structures, a desirable combination of the power source side contact unit and the mechanism unit is attainable, and it is accordingly possible to readily cope with the diversification of the specification by combining previously manufactured units in accordance with the specification.

DESCRIPTION OF THE PREFERRED EMBODIMENTS

There exist circuit breakers having various kinds of contact structures for one rated current in respect of characteristics such as a breaking speed and a current-limiting effect or in respect of economy. For example, there exist a high performance type circuit breaker having two current-limiting repulsion contact structures, a standard type circuit breaker having one current-limiting repulsion contact structure in which both power side contact and load side contact are movable contacts, and an economical type circuit breaker having one current-limiting repulsion contact structure in which a power source side contact is a fixed one and a load side contact is a movable one. Moreover in case of a small capacity, used is an economical type circuit breaker in which a power source side contact is a normal fixed contact without a current-limiting repulsion function. In these circuit breakers, the structures of the power source side contacts are different from one another, but the structures of the load side movable contacts and component parts occupying locations subsequent to the load side movable contacts are commonly used in the various circuit breakers. Under such condition, according to the invention, the circuit breaker is separated between the power source side contact and the load side movable contact into two units. The units are combined to each other so as to construct the circuit breaker which readily copes with various specifications.

Figure 1:
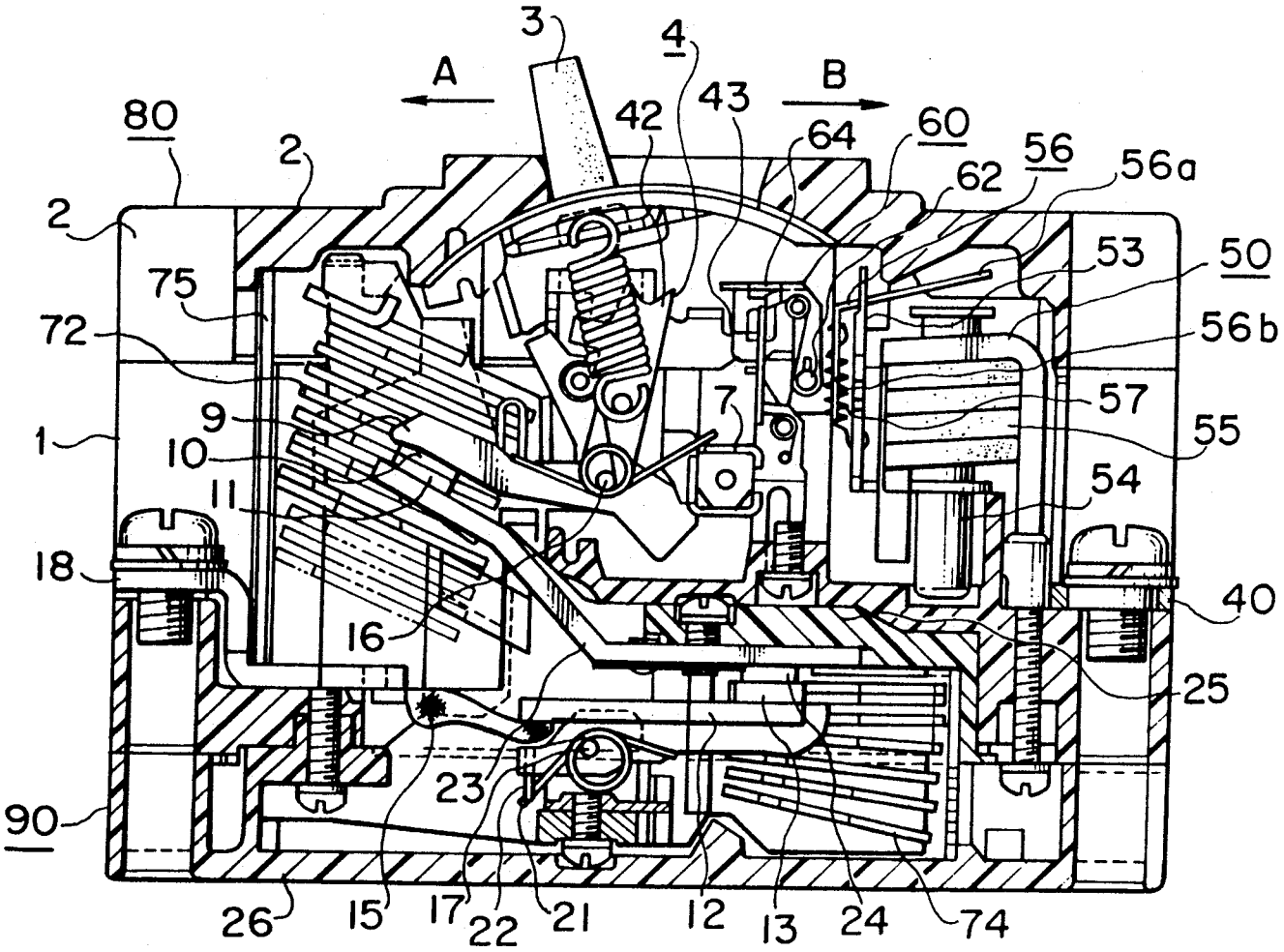
FIG. 1 is a sectional view showing a circuit breaker according to a first embodiment of the invention.

Referring to FIG. 1, a circuit breaker of a first embodiment is a three-pole circuit breaker. It comprises a resin mold casing 1 and a resin mold cover 2, which define therebetween a case in which mechanism unit 80 and power source side contact unit 90 integrally combined to each other. The mechanism unit 80 contains a movable contact 10, a load side terminal 40, a switching mechanism 4, an overcurrent detecting means 50 and a tripping means 60. The power source side contact unit 90 includes a power source side terminal 18, a power source side contact 11, and a mount 25 on which the terminal 18 and the contact 11 are mounted.

In this first embodiment, the mechanism unit 80 operating as a movable contact unit includes the electromagnetic overcurrent detecting means 50 having oil dash pot relays 52 at the respective poles. The oil dash pot relays 52 possesses an L-shaped yoke 53, a cylinder 54 secured to one of arms of the L-shaped yoke 53, in which viscous oil (not shown) and a piston of a magnetic substance (not shown) are sealingly contained, a coil 55 wound around the cylinder 54, and a movable core 56 secured to the other arm of the yoke 53, having an attraction part **56*a* to be attracted to a top of the cylinder 54 and an actuator 56*b* for transmitting the attraction movement of the attraction part 56*a* to the tripping means 60. One end of the coil 55 is connected to a movable contact arm 9 on which the movable contact 10 is provided, and the other end thereof is connected to the load side terminal 40. The movable core 56 is urged by a spring 57 to be ordinarily positioned at a location remote from the top of the cylinder 54. When an overcurrent (approximately 125% of the rated current flows through an electric circuit extending from the movable contact 10 via the coil 55 to the load side terminal 40, the piston within the cylinder 54 is attracted to come closer to the top of the cylinder 54 by the electromagnetic force of the coil 55 so that the magnetic reluctance of the cylinder is decreased and the movable core 56 is attracted to the top of the cylinder 54. Further, when a large current (more than 300% of the rated current) such as a short-circuit current flows through the electric circuit, the movable core 56 is directly attracted to the top of the cylinder 54 by the electromagnetic force of the coil 55. To cope with different rated currents, numbers of turns of the coils 55** are changed.

The tripping means 60 includes a common tripping shaft 62 and a tripping member 64. The shaft 62 is provided to perform tripping operation even if any one of the oil dash pot relays at the respective phases operates The tripping member 64 is normally engaged with a hook 43 of the switching mechanism 4 and is released from engagement with the hook 43 when the common tripping shaft 62 moves at a predetermined distance.

When the movable core 56 is attracted to the cylinder 54 in case of the overcurrent or the large current, the actuator **56*b* of the movable core 56 swings in a clockwise direction in FIG. 1, to thereby rotate the common tripping shaft 62 of the tripping means 60 in the clockwise direction. Thus, the hook 43 is released from engagement with the tripping member 64**, and the tripping operation is accordingly performed.

The switching mechanism 4 includes an operation handle 3 for performing an ON-OFF operation, a toggle link mechanism 42 to transmit the movement of the operation handle 3 to the movable contact arm 9, the hook 43 for transmitting the movement of the tripping means 60 to the toggle link mechanism 42, the movable contact arm 9 having the movable contact 10, and a cooperating shaft 7 for simultaneously cooperating the movable contact arm 9 at the three poles. Under a normal switching condition, the hook 43 is engaged with the tripping member 64 so as to maintain the toggle link mechanism 42 in an expanded state. After the tripping operation, the hook 43 is released from the engagement with the tripping member 64 so as to rotate in a counter clockwise direction in FIG. 1. As a result, the toggle link mechanism 42 is operated to rotate the movable contact arm 9 in the clockwise direction, thereby opening the poles.

The normal ON-OFF operation of the circuit breaker is performed by moving the operation handle 3 projecting from the cover 2 in a direction indicated by an arrow A or B. When the operation handle 3 is moved to the power source side, i.e., in the direction of the arrow A, a two-section link of the switching mechanism 4 including the toggle link mechanism 42 moves so as to make counter clockwise rotative movement of the cooperation shaft 7, which is connected to the movable contact arm 9 engaged with one end of the toggle link mechanism 43. Subsequently, each of the movable contact arm 9 moves around a pin 16 simultaneously at the three poles so that the movable contact 10 disposed at one end of the movable contact arm 9 comes in contact with a fixed contact 11.

In this embodiment, a unit in which a fixed contact and a current-limiting contact are connected with each other in series is used as the power source side contact unit 90. The power source side contact unit 90 includes the power source side terminal 18, a fixed contact table 23 electrically connected to the power source side terminal 18 through a current-limiting contact table 12 and current-limiting contacts 13 and 24. The power source side contact unit 90 also includes the fixed contact 11 secured to the fixed contact table 23 as a power source side contact, the mount 25 on which the fixed contact table 23 is mounted, and a contact section casing 26. The fixed contact table 23 is so secured to the mount 25 by means of screw fasteners that the fixed contact 11 is disposed to opposite to the movable contact 10. The current-limiting contact 24 is secured to the fixed contact table 23 at its one end opposite to the fixed contact 11.

A current-limiting contact table 12 having at its one end the current-limiting contact 13 facing to the current-limiting fixed contact 24 is disposed below the switching mechanism 4 and connected to the power source terminal 18 through a flexible conductor 15. The current-limiting contact table 12 is pivotally mounted by a pin 17. A return spring 21 is provided on the pin 17 for urging the current-limiting contact table 12 in the counter clockwise direction. The return spring 21 is engaged at its one end with a mount 22 and engaged at the other end with a part of the current-limiting contact table 12 adjacent to the current-limiting contact 13. Normally, the current-limiting contact 13 is in contact with the current-limiting fixed contact 24 by the reaction force of the return spring 21. The fixed contact 11 provided at the end of the fixed contact table 23 and the current-limiting fixed contact 24 are electrically connected to each other.

When the large current such as the short-circuit current flows through the circuit, an electromagnetic repulsion force acts between the current-limiting contact table 12 and the fixed contact table 23, and the current-limiting contact table 12 rotates in the clockwise direction so that the current-limiting contact 13 and the current-limiting fixed contact 24 move to be apart from each other. As a result, the current is limited by an arc generated between these contacts.

Incidentally, there are arc-extinguishing devices 72 and 74. A separator 75 is provided for preventing foreign matters from entering into the arc-extinguishing device 72, and includes small holes for discharging arc gas generated between the movable contact 10 and the fixed contact 11.

Figure 2:
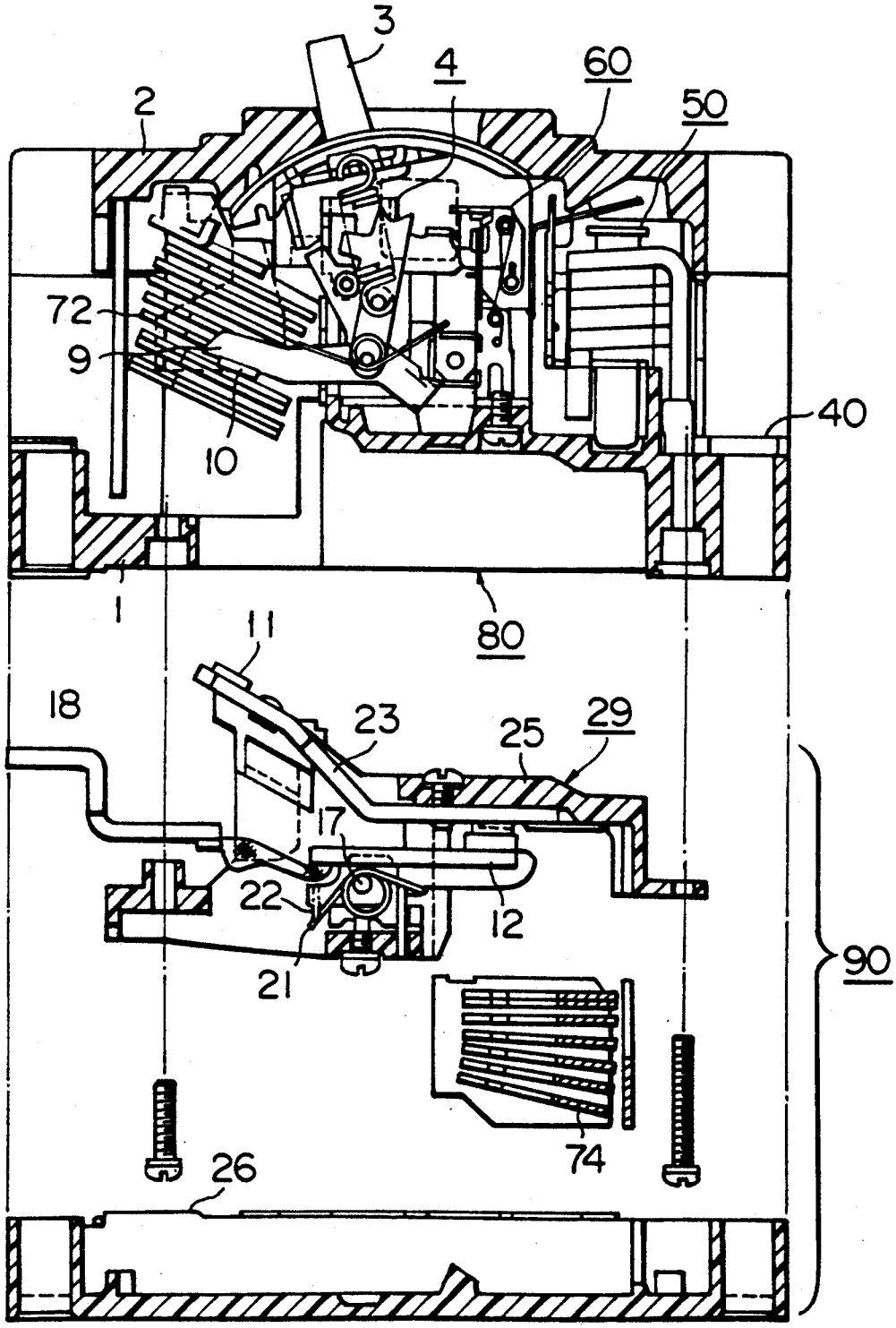
FIG. 2 shows assembling of the first embodiment in FIG. 1.
Figure 3:
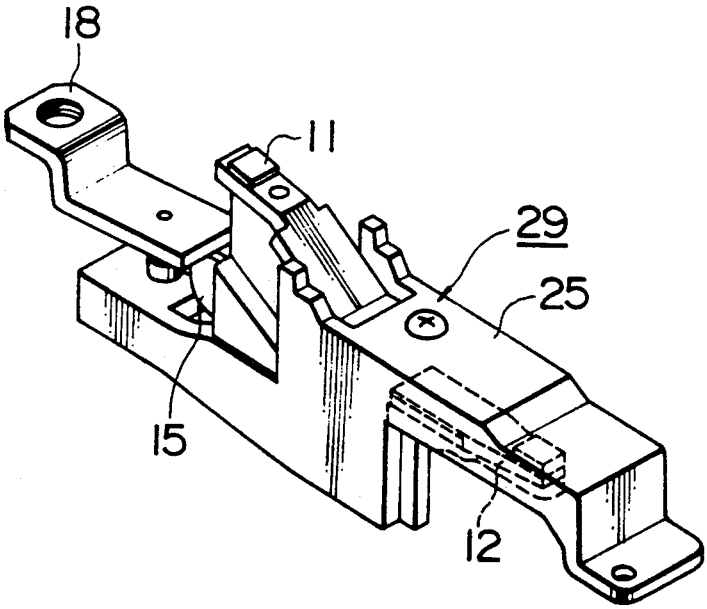
FIG. 3 is a perspective view of a fixed contact portion unit of the first embodiment.
Figure 4:
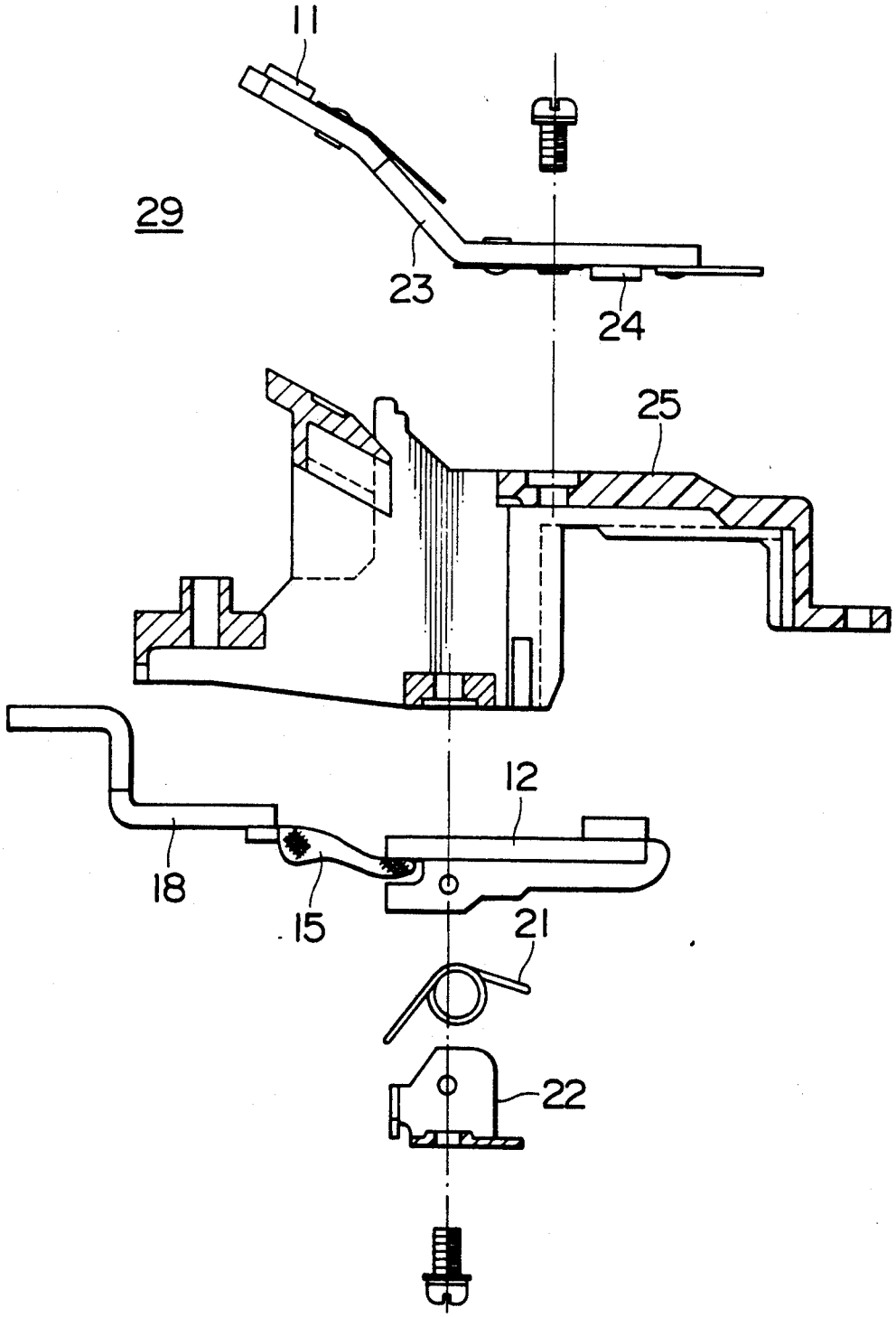
FIG. 4 shows assembling of the fixed contact portion unit of the first embodiment.
Figure 5:
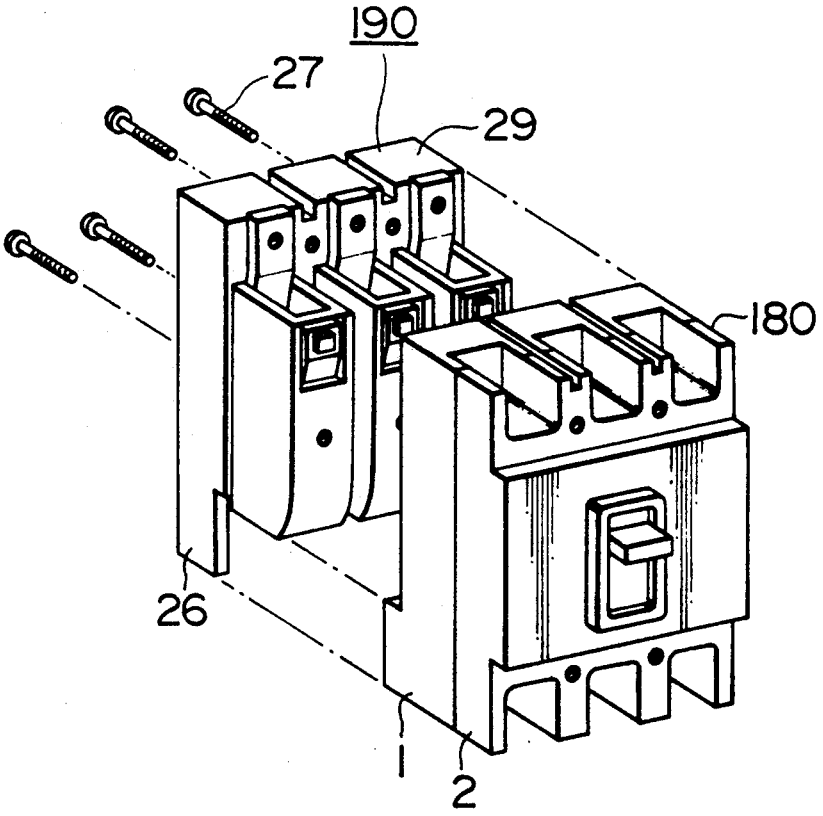
FIG. 5 is a perspective view of a circuit breaker according to a second embodiment of the invention, as viewed from the front side thereof.
Figure 6:
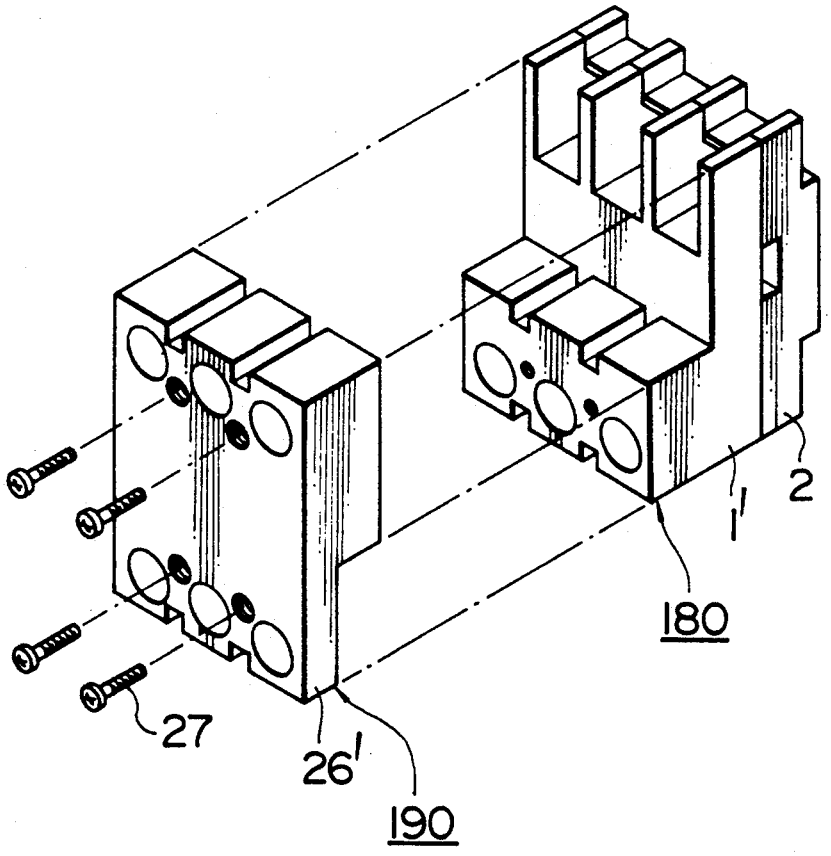
FIG. 6 is a perspective view of the circuit breaker showing the second embodiment of the invention, as viewed from the bottom side thereof.

Referring to FIGS. 2–4 a fixed contact portion unit 29 includes a resin molded mount 25 on which the fixed contact table 23, the current-limiting contact table 12, the power source side terminal 18 and the like are mounted. In order to mount the fixed contact portion unit 29 to the casing 1, the operation handle 3 is previously moved to the load side, i.e., in the direction of the arrow B to bring the switching mechanism 4 into an OFF state, that is, a state that the movable contact 10 is apart from the fixed contact 11, and then the fixed contact portion unit 29 is coupled to the mechanism unit 80 accommodated in the casing 1. Subsequently a contact section casing 26 is mounted to the casing 1 so as to complete the assembling.

In the above-mentioned manner, the assembling operation can be carried out readily without acting against the repulsion force of the return spring 21 which applies contact pressure. In the OFF state of the circuit breaker, since the mount 25 and the casing 1 are formed separately from each other, it is possible to elongate an electrical insulation distance between the fixed contact 11 and the movable contact 10, whereby insulation resistance and breaking capacity can be set at large values and deterioration of the insulation resistance in actual use can be restrained. Also, because an electrical connection is carried out between the movable contact 10 and the fixed contact 11, it is unnecessary to establish electrical connection in a narrow space after attaching the fixed contact portion unit 29 to the casing 1.

In this embodiment, three poles are integrally incorporated within the mechanism unit 80 because the three poles are required to be switched simultaneously. On the contrary, the power source side contact unit 90 is provided at every pole. For the reason, if one of the three poles is damaged owing to the condition of the load, the power source side contact unit 90 at the damaged pole has only to be exchanged.

Although the power source side contact unit in this embodiment includes the fixed contact and the current-limiting contact, it may be exchanged for a unit having only a fixed contact or only a current-limiting contact in accordance with a specification of the breaker. Further, the mechanism unit employs the electromagnetic type overcurrent detecting means, whereas the unit may otherwise employ a thermal type overcurrent detecting means utilizing a bimetal, or an overcurrent detecting means of a combination of the thermal type and the electro-magnetic type, or an electronic type overcurrent detecting means.

Figure 7:
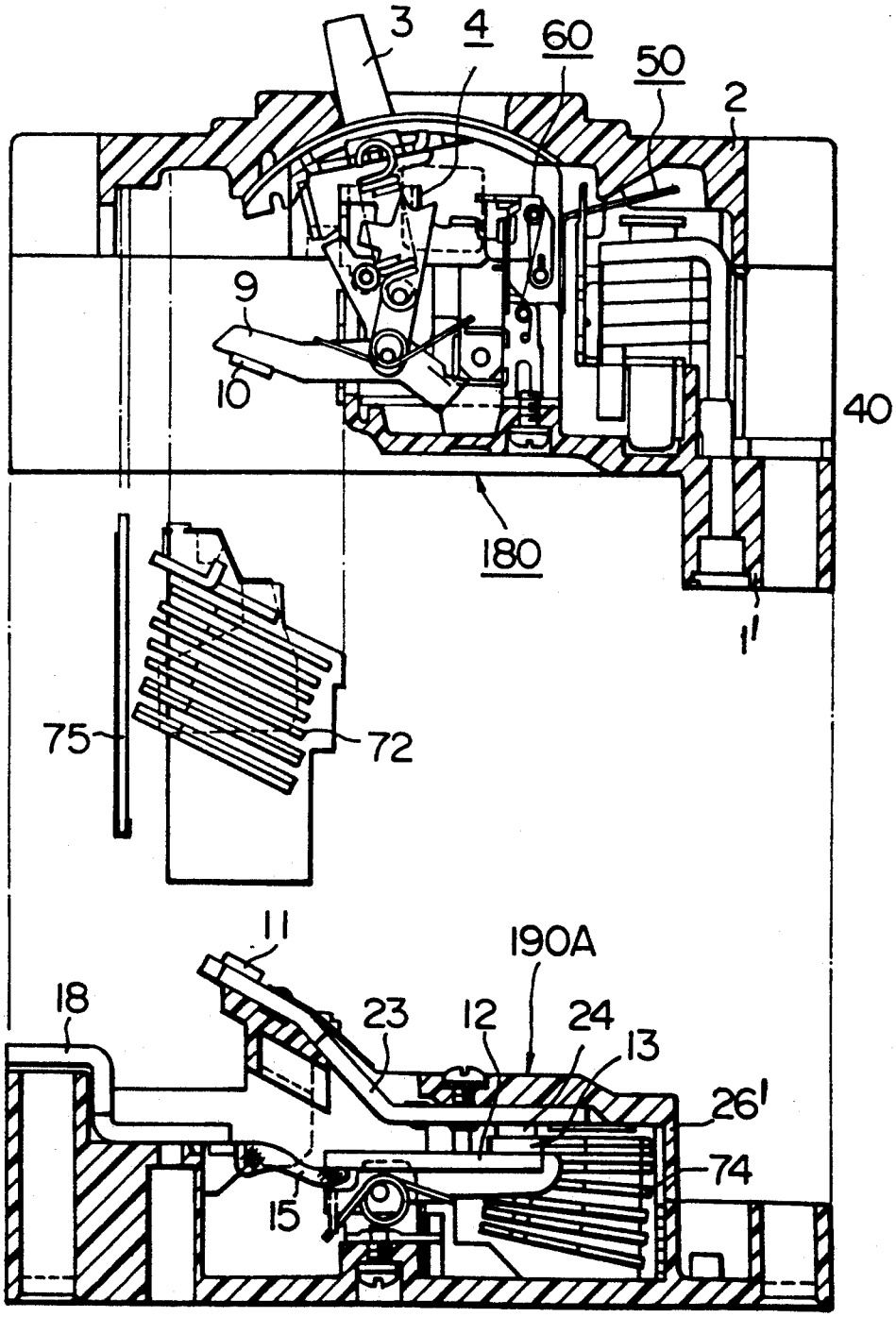
FIG. 7 is an exploded view showing a circuit breaker of a high performance type according to the second embodiment of the invention.
Figure 8:
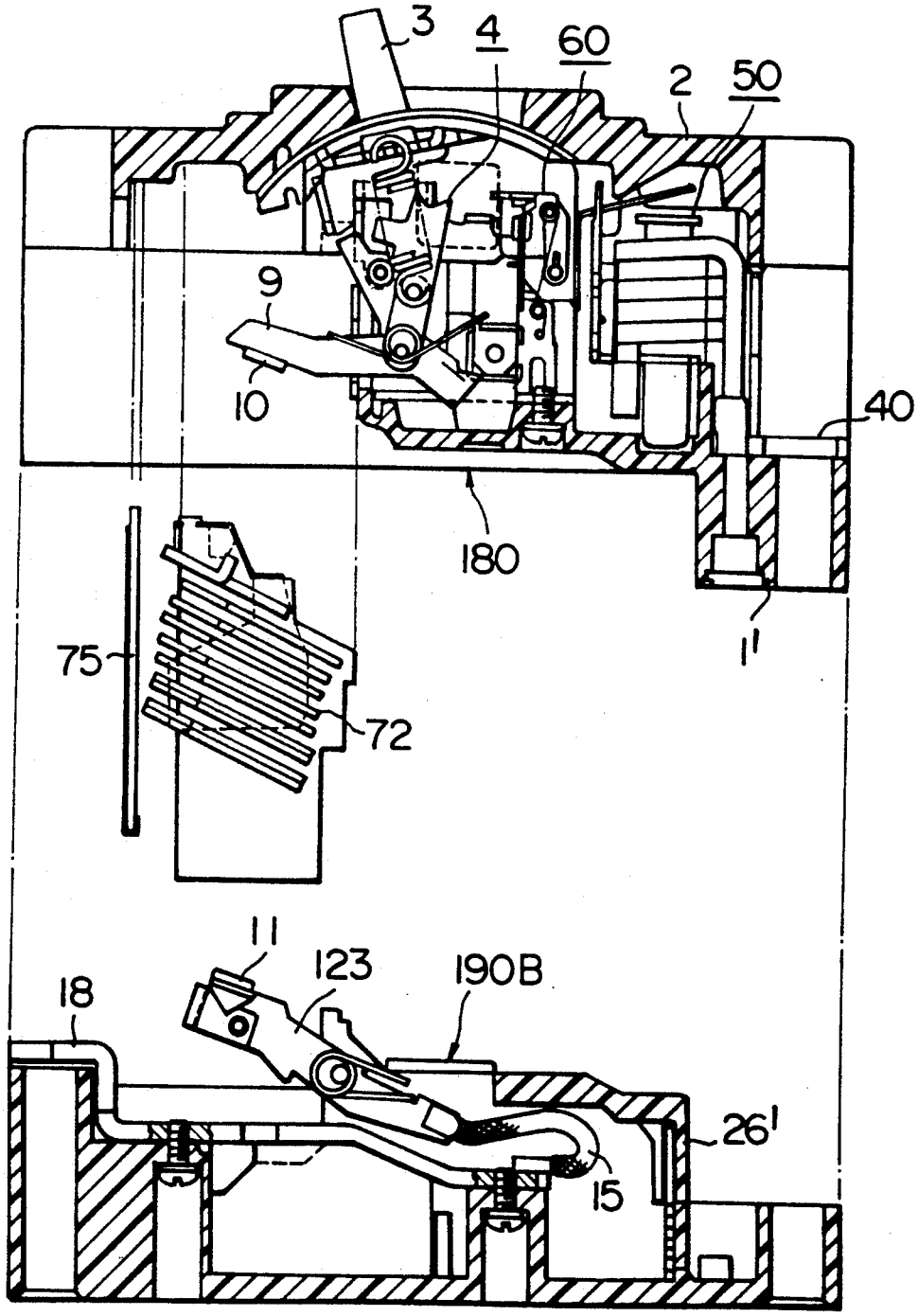
FIG. 8 is an exploded view showing a circuit breaker of a standard type according to the second embodiment of the invention.
Figure 9:
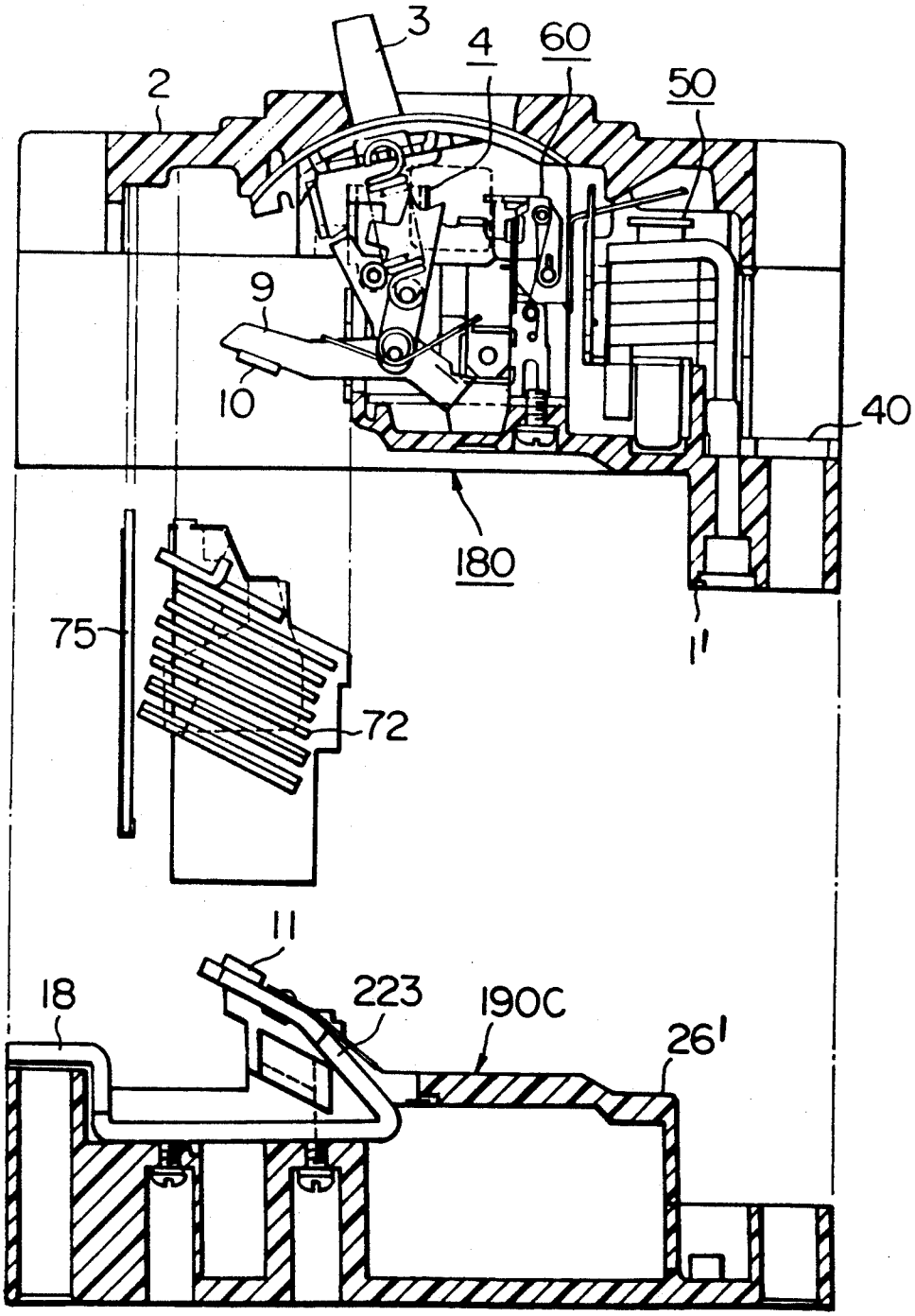
FIG. 9 is an exploded view showing a circuit breaker of an economical type according to the second embodiment of the invention.

A second embodiment of the invention will be described hereinafter with reference to FIGS. 5 to 11. As shown in the figures, three poles are integrally incorporated in a power source side contact unit 190. The power source side contact unit 190 is secured to a load side contact unit 180 by means of screws 27. In this embodiment, sizes and shapes of attachment portions of the power source side contact units with respect to the mechanism units, are unified so that they are interchangeable according to the specifications of contacts, as shown in FIGS. 7 to 9.

The second embodiment includes a construction similar to that of the first embodiment. More specifically, the circuit breaker according to the second embodiment comprises such two sections as a mechanism unit 180 and a load side contact unit 190. The mechanism unit 180 includes a switching mechanism 4, a movable contact arm 9 and the like are attached to a cover 2 and a casing 1'. The load side contact unit 190 includes a power source terminal table 18, a fixed contact table 23 and a current-limiting contact table 12 which are arranged in a contact section casing 26'. The contact section casing 26' is secured to the back side of the casing 1' through the screws 27. The contact section casing 26' possesses both functions of the mount 25 and the contact section casing 26 in the first embodiment in order to retain the power source side terminal table 18.

In this embodiment, because a circuit breaker is constructed by combining one selected from a plurality of kinds of mechanism units 180 and one selected from a plurality of kinds of fixed contact units 190, it is necessary that any combination of the selected mechanism unit and fixed contact unit causes no disadvantage.

Therefore, in the fixed contact unit 190, the contact structure of the high performance type circuit breaker, which structure is complicated and increased in size, becomes compact and is reduced to have a size substantially the same as that of the economical type circuit breaker. Further, the contact structures different from each other, for example, the economical type and the high performance type can be accommodated in the fixed contact portion units without changing an exterior dimension extremely. Because the connected portion of the mechanism unit 180 and the fixed contact unit 190 suffers from the force of the contact pressure when switching the contacts, both of the mechanism unit 180 and the fixed contact unit 190 must be connected securely. Since the connecting surfaces of the mechanism unit 180 and the fixed contact unit 190 exist at the contact section, the connecting surfaces are required to have structures of which electrical insulation are reinforced Accordingly, there are provided grooves (not shown) and ribs (not shown) for engagement with the grooves in order to elongate creeping distances between the respective poles FIG. 7 shows an example of a current-limiting circuit breaker in which a power source side contact unit 190A is employed as a high performance type one, which includes the fixed contact table 23 and the current-limiting contact table 12.

FIG. 8 illustrates an example of a current-limiting circuit breaker in which a power source side contact unit 190B is employed as a standard type one, which includes a contact table 123 with a couple reaction structure and the contact table on both of the power source side and the load side rotates during the current-limiting repulsion.

FIG. 9 indicates an example of a current-limiting circuit breaker in which a power source side contact unit 190C is employed as an economical type one, which includes a fixed contact table 223 bent into a substantially V-shaped form.

In the embodiments explained here, any one of the power source side contact units 190A, 190B and 190C is the current-limiting contact unit arranged such that the direction of the current flowing through the movable contact arm 9 and the direction of the current flowing through the power source side contact carrier 23, 123 or 223 opposing to the movable contact arm 9 are reversed so as to separate these contact tables from each other by the electromagnetic reaction force when flowing the large current. However, the power source side unit is not restricted to the current-limiting contact unit but it may be a power source side contact unit 190D in which the directions of the currents flowing through the movable contact arm and the power source side contact carrier are the same as each other and the electromagnetic reaction force is not used (see FIG. 11).

In these embodiments, since the sizes and configurations of the attachment portions of the contact section casings 26' to the mechanism units 180 are unified, it is possible to apply a desirable one selected from the plurality of power source side contact units 190, the structures of the contacts of which are different from one another, to the mechanism unit 180.

Figure 10:
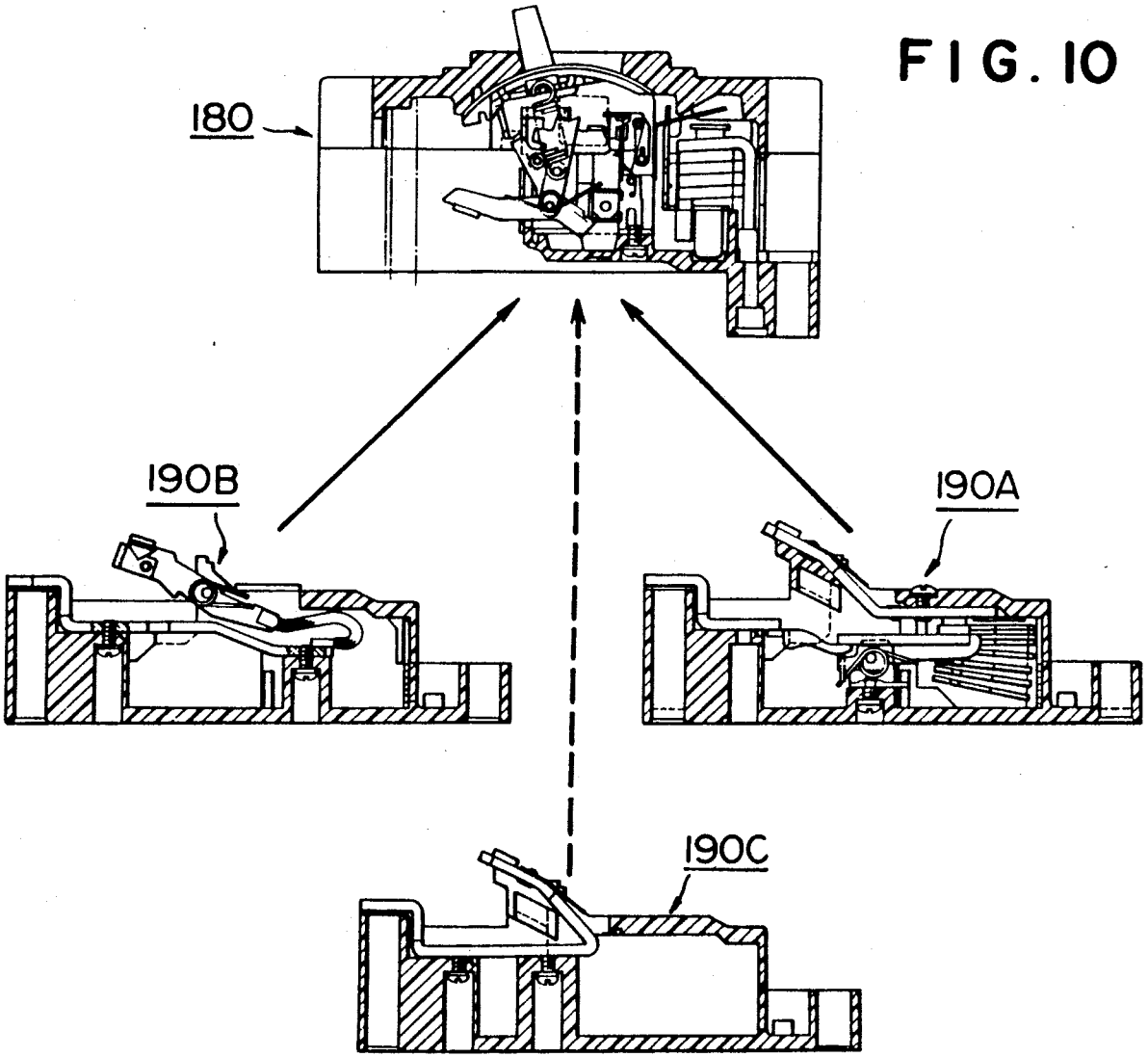
FIG. 10 is an explanatory view illustrative of combinations of a plurality of load side contact units with respect to one power source side contact unit in the second embodiment.
Figure 11:
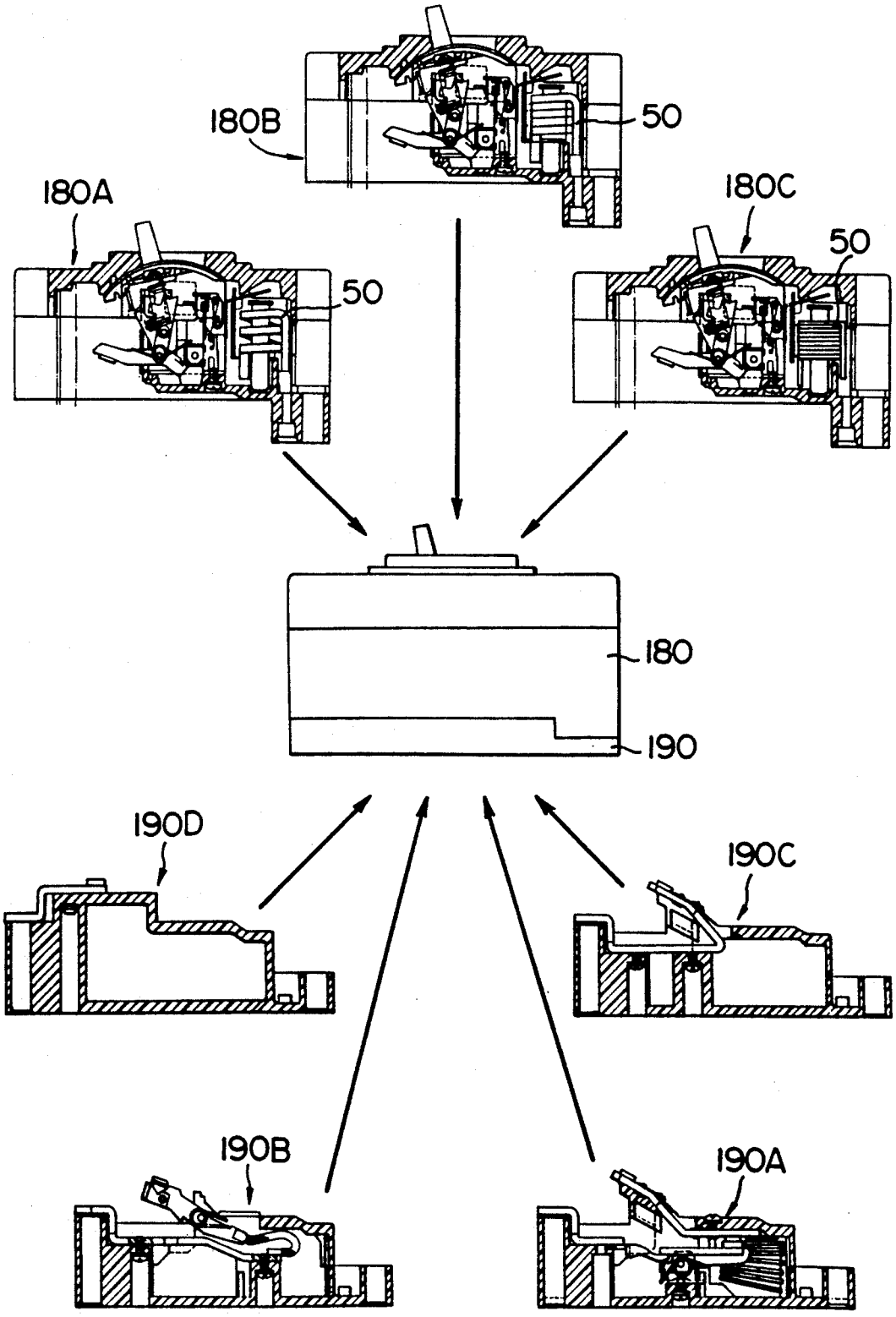
FIG. 11 is an explanatory view illustrative of combinations of a plurality of load side contact units and a plurality of power source side contact units in the second embodiment.

According to the second embodiment, as shown in FIG. 10, it is possible to desirably assemble the current-limiting circuit breakers having different characteristics, for example, of the high performance type, of the standard type and of the economical type, by respectively mounting any one of three kinds of types of fixed contact portion units 190A, 190B or 190C having the common external configurations to the same mechanism unit 180. The cover 2, the casing 1 and the contact section casing 26' which are molded component parts are commonly used to thereby reduce the number of component parts and improve an assembling efficiency. Therefore, the embodiment is effective in decreasing the manufacturing cost of the circuit breaker.

Alternatively, an arbitrary one can be selected from mechanism units having different rated currents with respect to one power source side contact unit. In other words, by arbitrarily selecting the mechanism unit 180 including the oil dash pot relay 52 for the required rated current, a circuit breaker suitable for such required current can be obtained.

More specifically, various kinds of combinations can be obtained by mounting one selected from the mechanism units 180A, 180B and 180C having different rated currents of, for example, 100A, 50A and 30A to single power source side contact unit 190. Further, by mounting one selected from mechanism units 180A, 180B and 180C to one selected from the power source side contact units 190A, 190B, 190C and 190D, more various combinations can be obtained. Accordingly, the embodiment is preferable for many kinds and a small quantity production.

In case of a circuit breaker of 100A frame, although fifty to sixty kinds (multiplying kinds of rated currents by kinds of braking capacities) of products are necessary to be stocked, it is sufficient to stock about twelve to fifteen kinds of units thanks to the desirable combinations of the mechanism unit 180 and the power source side contact units 190. Thus, control of stocks of products is considerably simplified, which results in a reduction of the number of controlling processes. Further, it becomes possible to cope with various kinds of needs to users flexibly owing to the production of the units.

Figure 12:
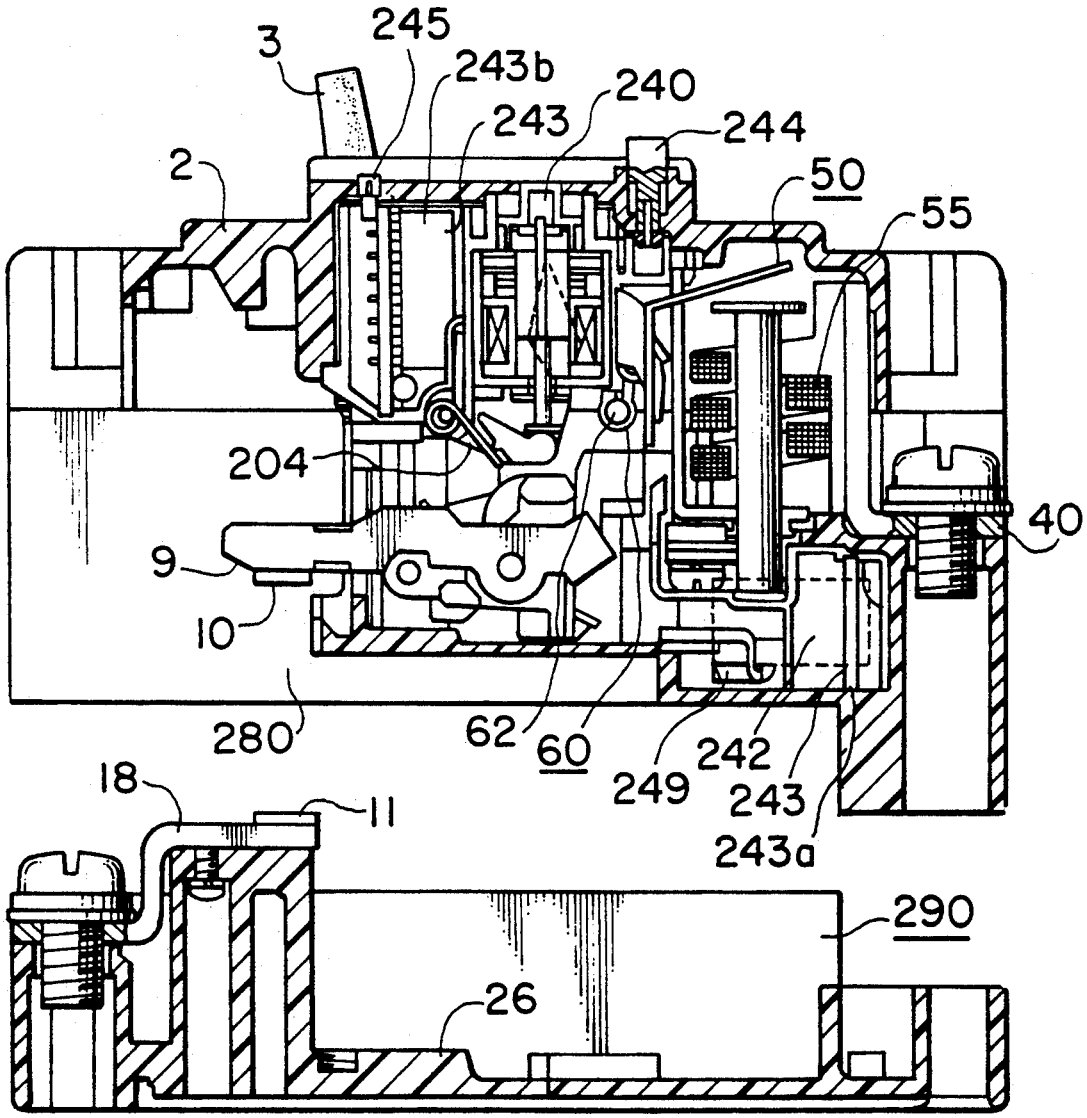
FIG. 12 is a sectional view of a circuit breaker according to a third embodiment of the invention.

A third embodiment of the invention will now be explained with reference to FIG. 12. In this embodiment, the invention is applied to an earth leakage circuit breaker with three poles. A mechanism unit 280 accommodates therein a movable contact arm 9, a switching mechanism 204, an overcurrent detecting means 50, a tripping means 60, a zero-phase current transformer 242, an earth leakage detecting circuit 243, and a magnetic tripping device 240. The movable contact arm 9 to which a movable contact 10 is fixed performs a switching operation through the switching mechanism 204 operated by a handle 3. The movable contact arm 9 is electrically connected to a coil 55 of the oil dash pot relay 50, which serves as the overcurrent detecting means, through a conductor 249 extending through the zero-phase current transformer 242, and is further electrically connected to a load side terminal 40 via the coil 55. An output port of the zero-phase current transformer 242 leads to the earth leakage detecting circuit 243. In this embodiment, for spacial reasons, the earth leakage detecting circuit 243 is divided into a circuit portion **243*a* for detecting a leakage current and a circuit portion 243*b* for outputting a tripping signal with a predetermined characteristic in accordance with the output of the zero-phase current transformer 242. The earth leakage detecting circuit 243 is connected to the magnetic tripping device 240. The earth leakage detecting circuit 243 supplies the tripping signal to the magnetic tripping device 240 for forcing the same to perform the tripping operation when the leakage is detected. In addition, reference numerals 245 and 244 designate a sensitivity switching knob and a test button of the leakage current detecting circuit 243, respectively. In this embodiment, when an overcurrent flows, the oil dash pot relay 50 rotates a common tripping shaft 62 of the tripping means 60 in the clockwise direction so as to trip the switching mechanism 204. When the current leaks, the operation of the magnetic tripping device 240 is transmitted to the tripping means 60** to perform the tripping operation similarly.

A power source side contact unit 290 comprises a fixed contact table 223 and a contact section casing 26 for retaining the fixed contact table 233. The table 223 is connected at one end thereof to the power source side terminal 18 and at the other end thereof to the fixed contact 11. In FIG. 12, an illustration of an arc-distinguishing device is omitted. According to this embodiment, it is possible to arbitrarily apply one selected from the mechanism units 280 whose rated currents are different from one another to one power source side contact unit 290. As shown in FIG. 12, sizes and shapes of connecting portions between the mechanism unit and the power source side contact unit are standardized similarly to those of the circuit breaker according to the second embodiment, to thereby realize more various kinds of combinations.

As mentioned above, according to the present invention, the current-limiting contact type circuit breaker becomes more useful. In spite of a small number of kinds of component parts, many kinds of products are available. Also, reliability of a product is enhanced by improving assembling efficiency and a breaking capacity. It is possible to economically manufacture various types of small-sized circuit breakers having high performance so as to remarkably cope with various needs against the products by users.

What is claimed is:

1. A circuit breaker, comprising:

a power source side contact unit including a power source side terminal, a power source side contact connected to said power source side terminal, a power source side contact carrier to which said power source side contact is secured, and a mount on which said power source side contact carrier is mounted; and a movable contact unit including a movable contact, a movable contact arm to which said movable contact is secured, a load side terminal connected to said movable contact arm, a mechanism for switching said movable contact arm, means for detecting an overcurrent flowing through said movable contact, means for tripping said switching mechanism by an operation of said overcurrent detecting means, and a casing accommodating therein said movable contact, said load side terminal, said switching mechanism, said overcurrent detecting means and said tripping means, said power source side contact unit and said movable contact units being integrated with each other by attaching said mount to said casing.

2. A circuit breaker according to claim 1, wherein said movable contact unit includes a plurality of said contacts for the respective of phases, and a plurality of said power source side contact units are provided, each of which includes said contact for the corresponding phase.

3. A circuit breaker according to claim 1, wherein said movable contact unit includes a plurality of said contacts for the respective of phases, and said power source side contact unit also includes a plurality of said contacts for the respective of phases.

4. A circuit breaker according to claim 1, wherein said movable contact unit includes an earth leakage tripping means which detects leakage of a current for tripping said switching mechanism.

5. A circuit breaker, comprising:

a movable contact unit including a movable contact, a movable contact arm to which said movable contact is secured, a load side terminal connected to said movable contact arm, a mechanism for switching said movable contact arm, means for detecting an overcurrent flowing through said movable contact, means for tripping said switching mechanism by an operation of said overcurrent detecting means, and a casing accommodating therein said movable contact, said load side terminal, said switching mechanism, said overcurrent detecting means and said tripping means; and either one of a first power source side contact unit and a second power source side contact unit being selectively connected to said movable contact unit, said first power source side contact unit including a power source side terminal, a power source side contact electrically connected to said power source side terminal, a power source side contact carrier to which said power source side contact is secured, and a mount on which said power source side contact carrier is fixedly mounted, said power source side contact carrier disposed such that a current flows therethrough in a direction reverse to that of a current flowing through said movable contact arm, and said second power source side contact unit including a power source side terminal, a power source side contact electrically connected to said power source side terminal, a power source side contact carrier to which said power source side contact is secured, and a mount on which said power source side contact carrier is rotatively mounted, so as to be rotated by repulsion force generated between said movable contact arm, said power source side contact carrier disposed such that a current flows therethrough in a direction reverse to that of a current flowing through said movable contact arm.

6. A circuit breaker, comprising:

a movable contact unit including a movable contact, a movable contact arm to which said movable contact is secured, a load side terminal connected to said movable contact arm, a mechanism for switching said movable contact arm, means for detecting an overcurrent flowing through said movable contact, means for tripping said switching mechanism by an operation of said overcurrent detecting means, and a casing accommodating therein said movable contact, said load side terminal, said switching mechanism, said overcurrent detecting means and said tripping means; and either one of a first power source side contact unit and a third power source side contact unit being selectively connected to said movable contact unit, said first power source side contact unit including a power source side terminal, a power source side contact electrically connected to said power source side terminal, a power source side contact carrier to which said power source side contact is secured, and a mount on which said power source side contact carrier is fixedly mounted, said power source side contact carrier disposed such that a current flows therethrough in a direction reverse to that of the current flowing through said movable contact arm, and said third power source side contact unit including a power source side terminal, a power source side contact electrically connected to said power source side terminal, a power source side contact carrier to which said power source side contact is secured, and a mount on which said power source side contact carrier is rotatively mounted, so as to be rotated by repulsion force generated between said movable contact arm, said power source side contact carrier disposed such that a current flows therethrough in a direction similar to that of the current flowing through said movable contact arm.

7. A circuit breaker, comprising:

a power source side contact unit including a power source side terminal, a power source side contact electrically connected to said power source side terminal, a power source side contact carrier to which said power source side contact is secured, and a mount on which said power source side contact carrier is mounted; and either one of a first movable contact unit and a second movable contact unit being selectively connected to said power source side contact unit, said first movable contact unit including a movable contact, a movable contact arm to which said movable contact is secured, a load side terminal connected to said movable contact arm, a mechanism for switching said movable contact arm, means for detecting an overcurrent flowing through said movable contact, means for tripping said switching mechanism a first rated current corresponding to by an operation of said overcurrent detecting means, and a casing accommodating therein said movable contact, said load side terminal, said switching mechanism, said overcurrent detecting means and said tripping means, and said second movable contact unit including a movable contact, a movable contact arm to which said movable contact is secured, a load side terminal connected to said movable contact arm, a mechanism for switching said movable contact arm, means for detecting an overcurrent flowing through said movable contact, means for tripping said switching mechanism corresponding to a second rated current by an operation of said overcurrent detecting means, and a casing accommodating therein said movable contact, said load side terminal, said switching mechanism, said overcurrent detecting means and said tripping means.

8. A circuit breaker, comprising:

a power source side terminal;

a power source side contact electrically connected to said power source side terminal;

a power source side contact carrier to which said power source side contact is secured;

a movable contact provided facing to said power source side contact;

a movable contact arm to which said movable contact is secured;

a load side terminal connected to said movable contact arm;

a mechanism for switching said movable contact arm;

means for detecting an overcurrent flowing through said movable contact;

means for tripping said switching mechanism by an operation of said overcurrent detecting means;

a casing for accommodating therein said movable contact, said movable contact arm, said load side terminal, said switching mechanism, said over-current detecting means and said tripping means; and a mount to which said power source side contact carrier is attached, said mount detachably mounted on said casing.

* * * * *